United States Patent [19]

Towns et al.

[11] Patent Number: 4,793,122

[45] Date of Patent: Dec. 27, 1988

[54] TAMPER-INDICATING CLOSURE FOR A CONTAINER, CONTAINER AND METHOD FOR MAKING SAME

[75] Inventors: Edward J. Towns, Convent Station; Edward M. Brown, Livingston, both of N.J.; William M. Lester, Del Ray Beach, Fla.

[73] Assignee: TBL Development Corporation, Livingston, N.J.

[21] Appl. No.: 443,608

[22] Filed: Nov. 22, 1982

Related U.S. Application Data

[63] Continuation-in-part of Ser. No. 441,109, Nov. 12, 1982.

[51] Int. Cl.[4] ..... B65B 61/00; B67B 3/20

[52] U.S. Cl. ..... 53/421; 53/490; 215/250

[58] Field of Search ..... 215/203, 209, 211, 213, 215/214, 219, 220, 230, 232, 247, 250, 252, 257, 258, 329, 341, 343, 344, 347, 349, 350, 351, 348, 365, 366; 116/200, 212, 306, 307; 73/262; 49/13; 220/219, 258, 309, 359, 278; 53/421, 471, 490

[56] References Cited

U.S. PATENT DOCUMENTS

| | | | |
|---|---|---|---|
| 603,151 | 4/1898 | Norton . | |
| 810,334 | 1/1906 | Green . | |
| 939,602 | 11/1909 | Landon . | |
| 1,095,313 | 5/1914 | Davids . | |
| 1,916,977 | 7/1933 | Gutmann | 215/329 |
| 1,937,975 | 12/1933 | Mead | 220/278 X |
| 2,062,182 | 11/1936 | Kubitz | 220/278 X |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 3,489,307 | 1/1970 | Wenger | 215/351 X |
| 3,501,042 | 3/1970 | Risch et al. | 215/232 |
| 3,692,199 | 9/1972 | Mumford | 215/220 |
| 3,826,221 | 7/1974 | Ross . | |
| 3,896,959 | 7/1975 | Roy | 215/350 X |
| 3,899,295 | 8/1975 | Halpern . | |
| 3,923,198 | 12/1975 | Brochman | 220/359 |
| 4,069,935 | 1/1978 | Hampel | 215/203 |
| 4,381,840 | 5/1983 | Ostrowsly | 215/329 |
| 4,456,139 | 6/1984 | Kent | 215/252 |
| 4,461,389 | 7/1984 | Korn | 215/216 |

*Primary Examiner*—Stephen Marcus
*Assistant Examiner*—Bryon Gehman
*Attorney, Agent, or Firm*—Robin, Blecker & Daley

[57] ABSTRACT

A tamper-indicating container closure includes a closure member defining container closing expanse, a tamper-indicating element in the closure interiorly of the closure member and times movable with the closure member for both retaining the tamper-indicating element with the closure and for selectively tearing the tamper-indicating element. The movable times are inaccessible through the closing expanse of the closure member and the closure affords visibility therethrough of the condition of the tamper-indicating element.

In a typical jar container embodiment, the closure includes a cap having a disc-shaped rupturable telltale interiorly of the cap depending skirt and telltale retaining-tearing times extending from the cap interior surface downwardly into securement with the telltale disc and movable with the cap in the course of its rotative movement.

6 Claims, 5 Drawing Sheets

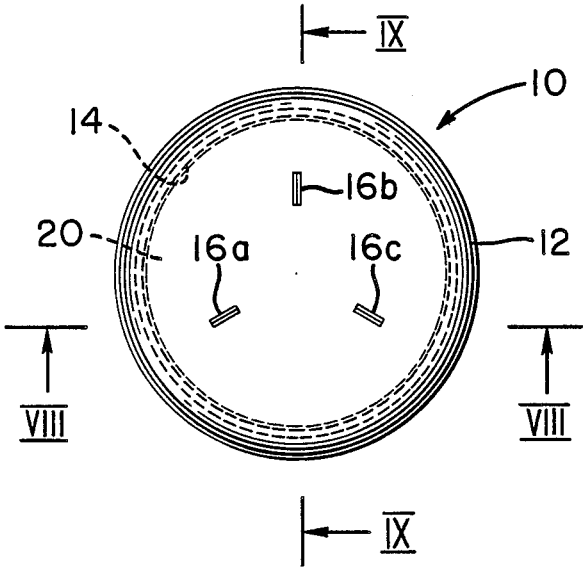
FIG. 7
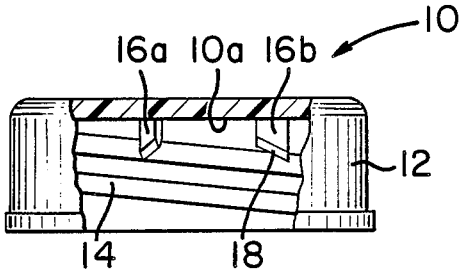
FIG. 9
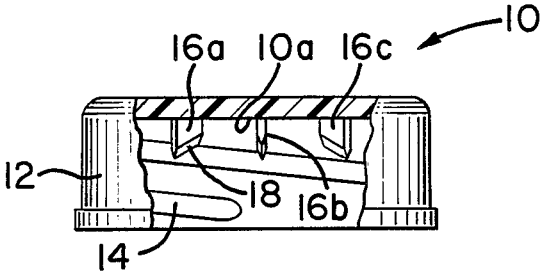
FIG. 8
FIG. 11
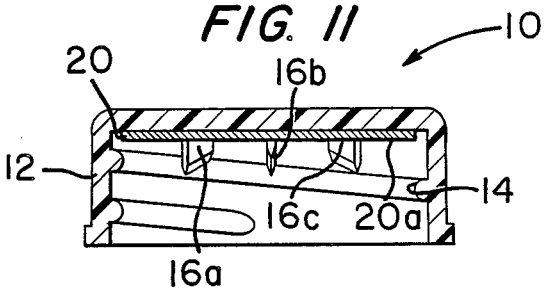
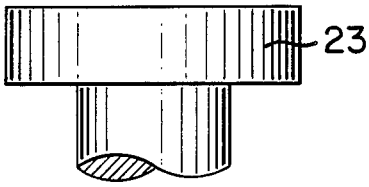
FIG. 12
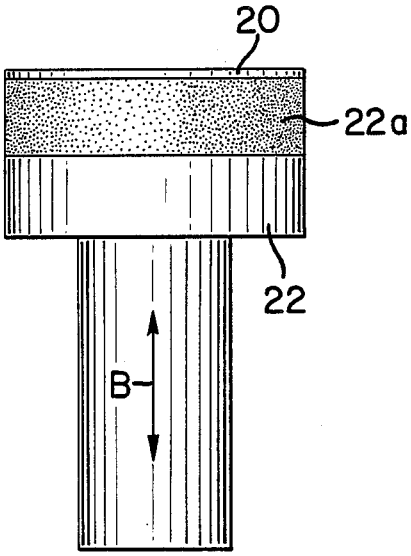
FIG. 10
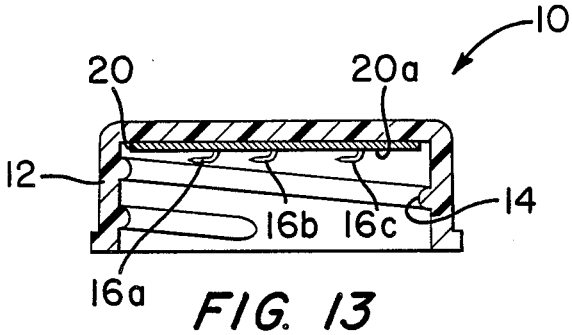
FIG. 13
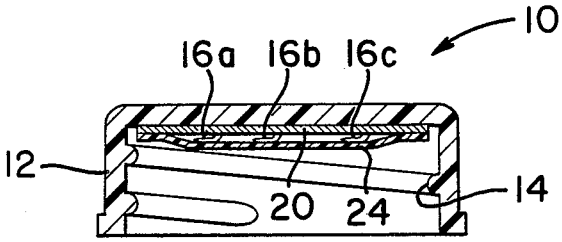
FIG. 14

TAMPER-INDICATING CLOSURE FOR A CONTAINER, CONTAINER AND METHOD FOR MAKING SAME

CROSS-REFERENCE TO RELATED APPLICATIONS

This application is a continuation-in-part of U.S. patent application Ser. No. 441,109, filed on Nov. 12, 1982 and entitled "Container with tamper indication and method for providing same".

FIELD OF THE INVENTION

This invention relates generally to containers of tamper-indicating type and pertains more particularly to closures providing containers with tamper indication.

BACKGROUND OF THE INVENTION

Recent domestic events have heightened the need for an effective manner in which to assure the uncontaminated delivery of contained products to a consumer, particularly medicinal products taken internally. Specifically needed is a container for such products which bears assuring indication to the consume that the contents have not been tampered with from their point of manufacture to the point of consumer sale.

A fundamental prior art approach toward meeting this need is seen in the so-called "telltale" indication, i.e., a readily discernible characteristic indicative of tampering, such as a signal that some person has previously attempted to gain access to the container contents. Broadly speaking, this approach can be generalized as placing a tamper-indicating member in the path of access to a container to indicate tampering by discernible change. Categorizing telltale types, one finds in the prior art approaches elements which evidence color change, which mechanically present literal messages, and which are ruptured or torn upon the occurrence of tampering. The color change devices may be considered less than desirable in requiring ambient-sensitive constituents and measures for sealing same from the ambient environment. The mechanical devices providing literal indication, i.e., the words "closed" or "open" are moved into a viewing window, are inherently complex and customized. Of these three categories, the rupturing and tearing practice offers the est potential for desired simplicity.

Prior art telltales may also be categorized in respect of the relative location of the telltale to the container access port. Here, one finds efforts in which the telltales are located directly at the access port and wherein the telltales are located otherwise in the path of access to the container. In the former locational practices, telltales directly span the access opening, e.g., are secured across the mouths of jars. In the latter practices, the telltales are located in container wrappers, within plastic sleeves which are heat shrunk about the capped jar, etc. Clearly, the effective location for a telltale is directly at the access port, since wrappers, heat shrunk plastic sleeves and like telltale items located outside the container cap may be removed and the remaining capped container is without tamper indicating capability.

Prior art telltale indication ma be further categorized as of types wherein the telltale directly at the access opening is closure member activated or not. In the cap activated category, reverse sense (opening) movement of the closure member brings some element into tearing relation with the telltale. In the non-activated case, the telltale is unaffected by closure member removal. Clearly, the closure member activated case affords greater security.

Specific prior art patents depicting the foregoing practices are identified and discussed in detail in the statement pursuant to 37 CFR 1.97 and 1.98 filed herein.

Of such prior art patents, Waring U.S. Pat. Nos. 2,131,774 and 2,131,775 may be considered to disclose tamper-indicating containers incorporating the desired of the foregoing categories of tamper indication. In these containers, the tamper-indicating element is simple rupturable sheet material. The element is located directly at the container mouth opening and is cap-activated. In accommodating this operative selection of features, however, Waring has vulnerability, recognized expressly in the '774 patent, to direct tampering with telltale element.

The Waring '774 practice is to provide a cap in the form of a hollow cylinder having a skirt depending from the cap top and interiorly threaded to receive the jar neck. The cap top is centrally open and prongs are formed in the plane of the cap and extend into the central opening. The telltale element is nested in the cap interior suitably secured therein. The cap with its nested telltale is then rotated into closed relation with the jar. Now the prongs are bent out of the plane of the cap top and into puncturing relation with the telltale element, remaining accessible through the open cap top.

In commenting on this aspect of his capped container, Waring states that if one tampers with the prongs, i.e., by end same out of such ruptured relation with the telltale element, the consumer can detect such tampering by observing the state of the prongs said to be deformed on reinsertion and by observing the state of the telltale element said to be thus marred. Such ultimate reliance on demanding observations and dutiful minute examination by the consumer renders the Waring approach ineffective, despite its inclusion of the most effective o the outlined prior art tamper-indicating practices. Its shortcoming indicates still another essential practice for providing effective taper indication, namely, that the rupturing elements and telltale must be maintained inaccessible.

In related considerations, applicants see as highly desirable characteristics of effective tamper indication such matters as equipping closure members with complete tamper-indicating capability at the point of their manufacture, enabling them to be made without customized cap structure or cap-working steps as in the Waring approach, and as adapted for use with the widespread varieties of caps currently in production. Thus, an effective tamper-indicating technique should accommodate existing commercial practices in the cap and container manufacturing industries.

SUMMARY OF THE INVENTION

The present invention has as its object the provision of a tamper-indicating practice accomodating the foregoing practice selections and also having characteristics accomodating such existing industrial practices in the related industries.

In attaining this and other objects, the invention provides a container closure having a closure member defining container closing expanse, a tamper-indicating element in the closure interiorly of the closure member and means movable with the closure member for both retaining the tamper-indicating element with the closure and for selectively tearing the tamper-indicating element, such movable means being inaccessible through the closing expanse of the closure member and the closure affording visibility therethrough of the condition of the tamper-indicating element. As will be further understood from the ensuing discussion of embodiments thereof, the container closures of the invention meet the foregoing practice selections by embodying the rupturing and tearing technique, by disposing the indicator member across the access port of a container capped by the closure, by having closure-activated tampering indication and by maintaining the indicator member and the means rupturing same inaccessible to the would-be tamperer.

In a typical jar container embodiment, the closure comprises a cap having a disc-shaped rupturable telltale interiorly of the cap depending skirt and telltale retaining-tearing means extending from the cap interior surface downwardly into securement with the telltale disc, such means being movable with the cap in the course of its rotative movement. Upon first sense closure movement into releasable securement with a jar neck, the entirety of the closure rotates in unison. At the end of such first sense movement, an adhesive upon the jar adjacent its mouth engages the telltale disc. Second sense closure movement to open the container gives rise to the selective activity of the retaining-tearing means, i.e. the cap and such means move in unison relative to the now jar-secured telltale disrupting the integrity thereof, as is then visible to a consumer through the transparent or translucent cap.

As will be appreciated, such article of manufacture of the invention also accomodates the above-noted related characteristics of effective tamper indication, i.e., the closures of the invention have complete tamper-indicating capability at the point of manufacture thereof, no cap-working at the point of container closing is involved, and by simple cap mold modification or the use of an insert discussed below, the invention is readily incorporatable in standard caps currently in production.

The foregoing and other objects and features of the invention will be further understood from the following detailed description of preferred embodiments of closures and containers thereof and methods of providing same and from the drawings now introduced.

DESCRIPTION OF THE DRAWINGS

FIG. 7 is a plan view of another embodiment of a closure cap in accordance with the invention.

FIG. 8 is a sectional view of the FIG. 7 closure cap as seen from plane VIII—VIII of FIG. 7.

FIG. 9 is a sectional view of the FIG. 7 closure cap as seen from plane IX—IX of FIG. 7.

FIG. 10 is a front elevational view of a telltale element applicator tool shown assembled with the telltale to be inserted in the FIG. 8 closure cap axially thereof.

FIG. 11 is a sectional view as would be seen from plane VIII—VIII of FIG. 7 upon insertion of the telltale of FIG. 10 therein and withdrawal of the applicator tool.

FIG. 12 is a front elevational view of a telltale element assembly tool for movement into the FIG. 11 preassembly axially thereof.

FIG. 13 is a sectional view as would be seen from plane VIII—VIII of FIG. 7 upon operation of the tool of FIG. 12 upon the assembly of FIG. 11.

FIG. 14 is a sectional view as would be seen from plane VIII—VIII of FIG. 7 upon securement to the FIG. 13 assembly of a container mouth closure layer.

DESCRIPTION OF PREFERRED EMBODIMENTS AND PRACTICES

Figure 2:
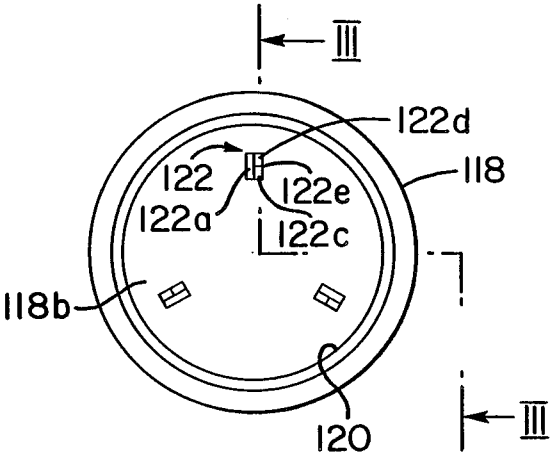
FIG. 2 is a bottom plan elevation of the cap of FIG. 1.
Figure 1:
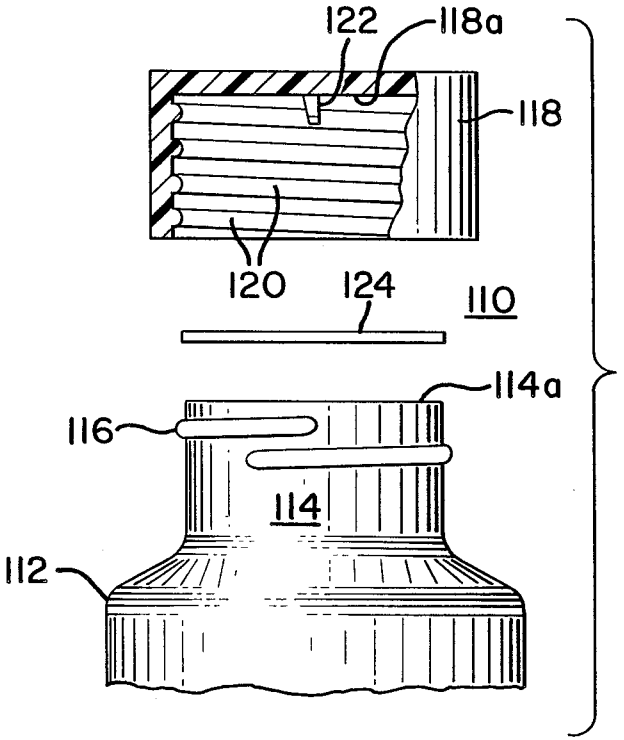
FIG. 1 is an exploded front elevation of the jar and cap of one embodiment of a container in accordance with the invention, the cap being broken away in part to show interior detail.

Referring to FIGS. 1 and 2, container 110 includes a vessel 112 of plastic or glass for such use a containing medicinal capsules or liquid, foodstuffs, and like consumer products, neck 114 of the jar being provided with closure threads 116 and terminating in open circular access opening or mouth 114*a*. In selecting plastic materials for jar 112, one looks to such thermoplastics as will provide a barrier to covert penetration, such as by use of a hypodermic needle. High impact styrene is suitable. As for cap 118, optically clear plastics of butyrate, acetate, nylon, lucite and plexiglass and the like are suitable.

Figure 3:
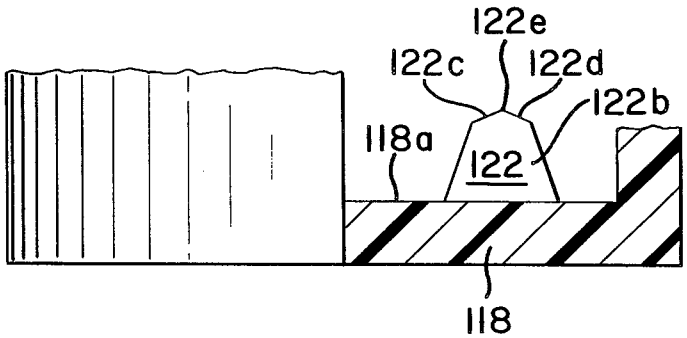
FIG. 3 is an enlarged inverted sectional view of the FIG. 1 cap as seen from broken plane III—III of FIG. 2.

Tines 122, which may be one or more in number, are shown arranged as three puncturing elements spaced at equal angles. Each tine may be formed integrally with cap 118, e.g., is molded therewith, and is rigid, such that it is not readily deflectable relative to cap undersurface 118*a*. In the illustrated puncturing element configuration of FIGS. 1–3, each tine includes an inclined surface 122*a*, a generally vertical surface 122*b* and end chamfers 122*c* and 122*d* extending to puncturing apex 122*e*. Based upon its secured relation to cap 118, each tine travels with the cap in the course of its first sense (clockwise) movement into releasably secured relation with jar 112 and also in the course of second opposite (counterclockwise) sense cap movement relative to the jar for release from secured relation therewith.

It will also be observed that tine 122 is radially offset from the center of the rotative movements of cap 118 and that the tine extends generally parallel to the axis of the hollow cylindrical cap. The tine is disposed radially of the rotation center, thus presenting its primary extent extending generally radially to provide a frontal expanse for rupture or tearing of indicating element 124, now discussed.

Figure 4:
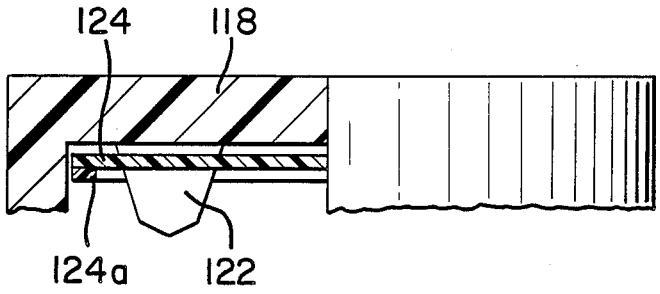
FIG. 4 is an enlarged segmented sectional view of the FIG. 1 cap assembled with the indicator member thereof.
Figure 5:
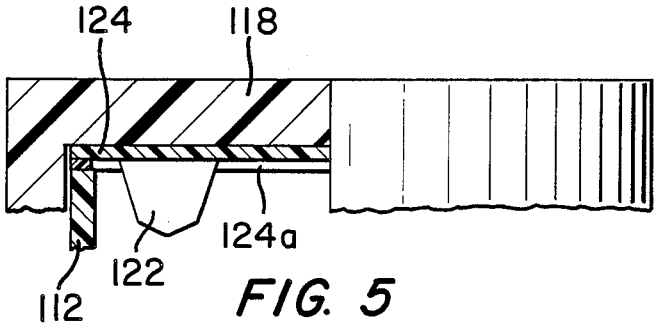
FIG. 5 is an enlarged segmented sectional view of the FIG. 1 container upon initial assembly of the cap with the jar thereof.

Indicating element 124 is preassembled with cap 118, as by forcing tine 122 therethrough as shown in FIG. 4, wherein element 124, typically a paper wafer or telltale known in the art, captively nests on tine 122 interiorly of cap 118, i.e., is retained by the tine. An adhesive 124*a*, such as an FDA-approved contact activated cement, may b carried as a layer on member 124. Referring to FIG. 5, the preassembled cap with indicating element applied to the tine is now assembled with jar 112, i.e., to effect initial closure thereof following point of manufacture filling with contents. Cap 118 is threaded onto the jar and, in the initial course of such first sense cap movement, indicating member 124 travels therewith remotely upwardly of jar mouth 114*a*. As the closing phase of first sense movement is attained, adhesive layer 124*a* engages the surface of jar 112 bounding mouth 114*a*. At this juncture where adhesive layer is a contact actuated cement, a bond occurs. A time setting cement may be likewise employed to obtain the requisite securement of indicating member to the jar and across the access opening thereof. The adhesive may, of course, be applied to the jar mouth rather than to element 124.

Figure 6:
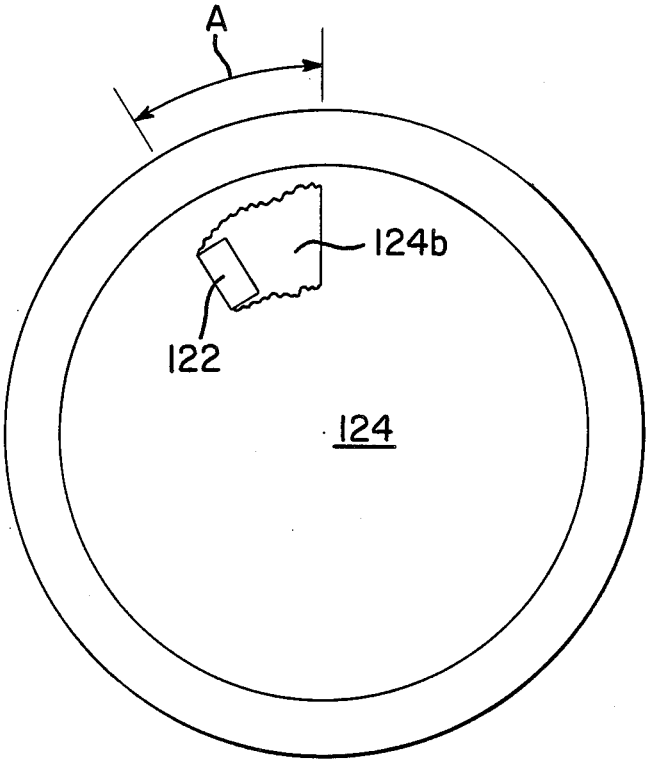
FIG. 6 is a schematic plan view of the FIG. 5 assembly upon container opening rotation of the cap thereof illustrating the telltale rupturing action of one of the rupturing elements.

Upon such closure of container 110, any reverse rotation of cap 118 relative to jar 112 will give rise to an attack upon the integrity of indicating element 124, such as the tearing thereof at 124*b* in FIG. 6 upon counterclockwise rotation of cap 118 from its secured position through angle A. The selective reverse rotation tearing of element 124 occurs since adhesive 124*a* has shear resistant bonding strength greatly exceeding the forces imposed upon element 124 by the tearing members 122. To be noted also is that element 124 has no connection to cap 118 other than through member 122. Cap 118 affords visibility of such condition of the indicating element exteriorly of the container as it is selected to be of material permitting such viewing therethrough.

In those instances in which the contents of container 110 are susceptible to atmospheric deterioration, tine 122 may be equipped with a sealant coating for purposes of resealing the puncture it causes in indicating element 124, or a sealant may be applied locally following the puncturing step.

Turning now to the embodiment shown in FIGS. 7 through 14, cap 10 has a depending skirt 12, interiorly threaded at 14. Tines 16*a–c* (FIGS. 8 and 9) are again symmetrically situated in cap 10 and are in knife form, each having cutting edge 18 extending radially inwardly and upwardly relative to cap undersurface 10*a*. In FIG. 10, tamper-indicating element 20 is disposed on application tool 22 and is inserted into cap 10 by movement of tool in upward direction B into the hollow of cap 14 indicated in FIG. 9. The portion 22*a* of tool 22 which supports element 20 is compressible to facilitate seating of element 20, as is shown in the preassembly of FIG. 11. While element 20 is retained on tines 16*a–c* by their piercing thereof, this embodiment and practice now makes use of a tine staking tool, such as is indicated by reference numeral 23 in FIG. 12. Tool 23 is inserted into the hollow of cap 10 as shown in FIG. 11 and is displaced upwardly into engagement with the ends of tines 16*a–c*. There results the preassembly shown in FIG. 13, wherein the tine ends return in generally arcuate course into flat non-tearing disposition generally parallel to undersurface 20*a* of element 20.

The step just described has benefit in enhancing the retention of the telltale element 20 in cap 10 and in enhancing the tearing thereof. Further, the step places the preassembly attained thereby in such posture that it may now receive an underlayer, as part of the cap as supplied by a cap manufacturer, having, its integrity unaffected by operation of the telltale. Thus, with the tine ends now not having their prior puncturing and tearing capability, jar mouth closure layer 24 is secured to the FIG. 13 preassembly at margins of element 20, as is indicated in FIG. 14, by interposed adhesive or other bonding.

Figure 15:
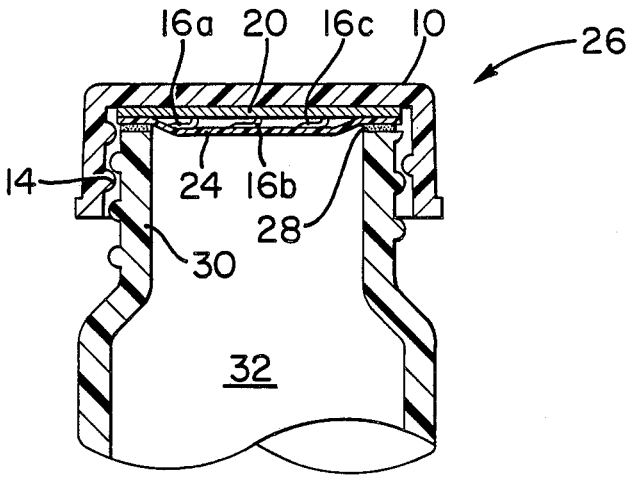
FIG. 15 is a sectional view as would be seen from plane VIII—VIII of FIG. 7 with the cap assembly of FIG. 14 further assembled with a jar, a sealant layer on the jar mouth securing the mouth closure layer of FIG. 14 to the jar mouth.

The container embodiment of FIG. 15 illustrates the capping use of the closure of FIGS. 7–14. Here, container 26 includes cap 10 with its underlayer 24 secured by adhesive 28 to the mouth of neck 30 of jar 32. Typically, adhesive 28 is applied to the jar and the cap would be supplied with its underlayer 24 not presenting adhesive to the jar. Such FIG. 15 embodiment is seen as particularly useful in instances in which fragments of the telltale element 20 will issue from the element upon the opening by a consumer of a tamper-free container. With the FIGS. 7–14 closure, such fragments of the telltale issue upon a layer having its integrity after jar opening, i.e., layer 24, and fragments can be disposed of before opening such sealing layer 24.

Figure 16:
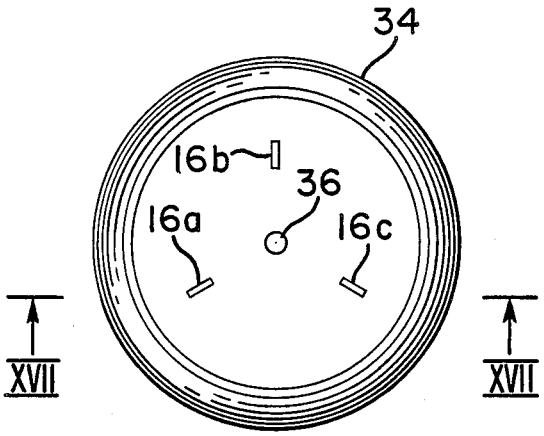
FIG. 16 is a plan view of another embodiment of a closure cap in accordance with the invention.
Figure 17:
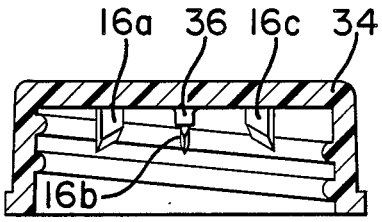
FIG. 17 is a sectional view of the FIG. 16 closure cap as would be seen from plane XVII—XVII of FIG. 16.
Figure 18:
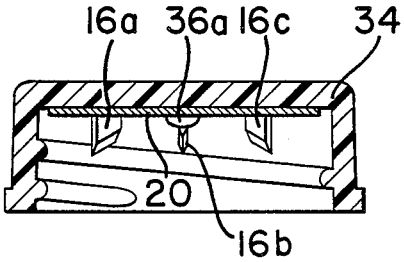
FIG. 18 is a sectional view of the FIG. 16 closure cap as would be seen from plane XVII—XVII of FIG. 16 with the telltale element applied therein and with the central retention spike staked upon the telltale element.

In the closure embodiment of FIGS. 16–18, closure member 34 includes spike 36 depending with tines 16*a–c* from cap undersurface 34*a* and centrally thereof. Following application of telltale element 20 to cap 34, spike 36 also extends therethrough with the tines. A staking or like operation is now performed, mushrooming the spike upon undersurface 20*a* of the telltale element as shown at 36*a* in FIG. 18. In the course of tearing of the telltale element, the staked spike captures the central fragment thereof in the cap.

Figure 19:
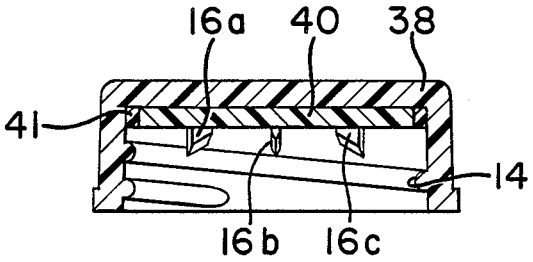
FIG. 19 is a sectional view of another embodiment of a closure cap in accordance with the invention wherein a telltale retaining-tearing insert is shown seated in the cap.

Convenience of manufacture suggests that the telltale retaining-tearing member or members (tines 16*a–c*) be formed integrally with the cap, as in the cases above shown. On the other hand, the invention contemplates the provision of the telltale retaining-tearing member as an insert to a standard unabridged cap, as is shown by the closure of FIG. 19. Here, cap 38 has insert 40 wedge-fit against compressible ring 41 or otherwise immovably captured in cap 38, the insert being preformed with its depending telltale activating elements.

Figure 20:
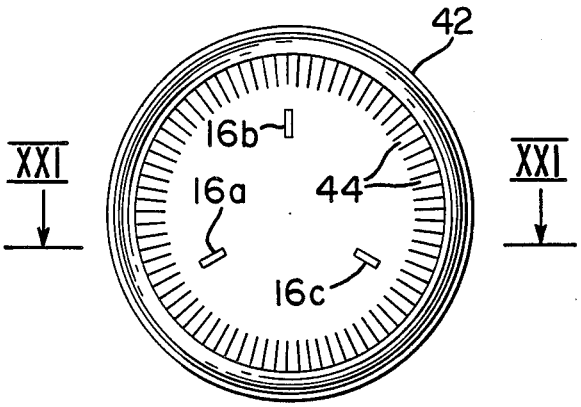
FIG. 20 is a top plan view of another embodiment of a closure cap in accordance with the invention wherein the cap includes radial ribs adapted to distribute cap closing force upon a telltale element.
Figure 21:
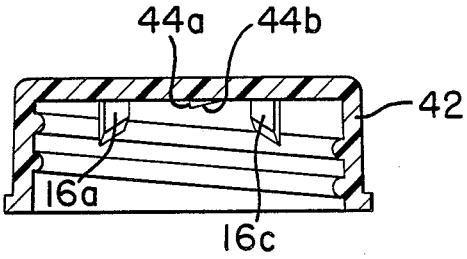
FIG. 21 is a sectional view of the FIG. 20 closure cap as would be seen from plane XXI—XXI of FIG. 20.
Figure 23:
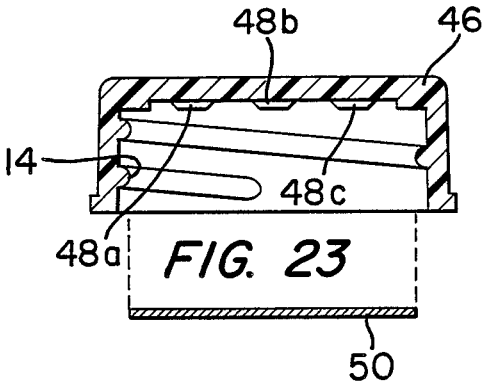
FIG. 23 is an exploded sectional view of a telltale element and the FIG. 22 cap as seen from plane XXIII—XXIII of FIG. 22.
Figure 22:
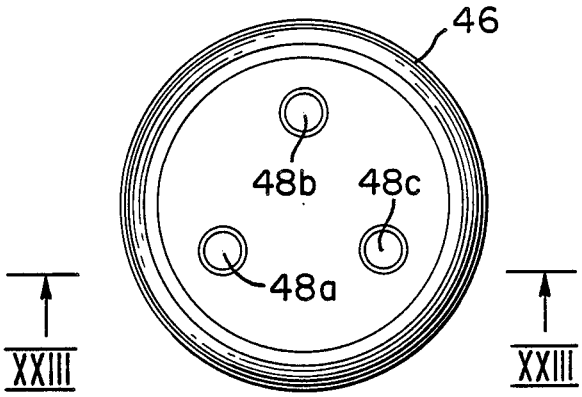
FIG. 22 is a plan view of a further embodiment of a closure cap in accordance wih the invention.
Figure 24:
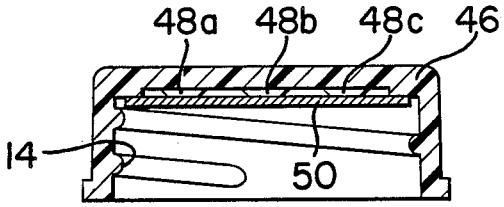
FIG. 24 is a sectional view of the FIG. 22 closure cap as would be seen from plane XXIII—XXIII of FIG. 22 with a telltale seated therein.
Figure 25:
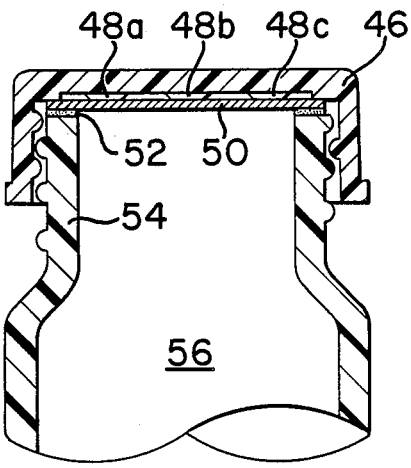
FIG. 25 is a sectional view as would be seen from plane XXIII—XXIII of FIG. 22 with the cap assembly of FIG. 24 further assembled with a jar, a sealant layer on the jar mouth securing the FIG. 24 assembly to the jar mouth.

In another embodiment, shown in FIGS. 20 and 21, cap 42 has radially extending ribs 44 formed in its undersurface and disposed outboard of its tines. The ribs have generally vertical rises 44*a* at their cap clockwise sides add trailing ramps 44*b* at their cap counterclockwise sides. With this arrangement, the cap clockwise (closing) rotative movement is accompanied by forceful engagement of rises 44*a* with the closure telltale element 20 along with the closure tines, effectively distributing the force applied to the telltale element and permitting use of a more delicate tamper-sensitive telltale. In reverse (opening) rotation, the ramps ride over the telltale surface, and tearing is effected by the tines.

Turning now to FIGS. 22–25, cap 46 has its telltale element retaining-tearing members 48*a*–48*c* in the form of plastic dimples or buttons extending outwardly of cap undersurface 46*a* and formed integrally therewith of plastic. Upon assembling cap 46 with telltale 50, which is of type having a plastic surface over underlying metal foil or the like, a plastic-to-plastic interface exists as between dimples 48*a–c* and the plastic surface of the teltale. By use of ultrasonic welding, or like technique for interbonding of plastic layers, telltale 50 is retained by dimples 48*a–c* and sufficient engagement is provided therebetween to effect tearing of telltale 50 by dimples 48*a*–48*c* upon rotation of cap 46 when the cap is secured by adhesive 52 to neck 54 of jar 56, such assembly being shown in FIG. 25.

Various changes in structure and modifications in practice may evidently be introduced in the foregoing particularly disclosed and described embodiments and methods without departing from the invention. Thus, such matters as container and cap configuration, tine structure, telltale selection and the like will be seen to be readily varied. Also, while discussion has been of such teltale integrity attacking techniques as puncturing or surface bond for retention and tearing for tamper indication, other integrity attacking techniques can be incorporated as desired. The preferred embodiments and practices are thus intended in an illustrative and not in a limiting sense. The true spirit and scope of the invention is set forth in the following claims.

We claim:

1. A method for providing tamper-indication for a container of type having a vessel for article containment and having an access opening, and a closure member for first sense movement relative to said vessel into securement therewith and in circumscribing relation to said access opening and for second opposite sense movement for release from such securement, said method comprising the steps of:

(a) disposing a retaining member interiorly of said closure member in dependent relation thereto and restraining said retaining member for travel with said closure member;

(b) applying an indicating element in retained relation to said retaining member for travel therewith;

(c) securing a closure element to said indicating element in contiguous unretained relation to said retaining member; and (d) engaging said closure member with said vessel and securing said closure element to said vessel adjacent said access opening upon engagement of said closure element with said vessel in the course of said first sense movement of said closure member, said retaining member and said indicating element being so selected as to provide for tearing of said indicating element by said retaining member on said second sense movement of said closure member.

2. The method claimed in claim 1 wherein said step (a) is practiced by forming said retaining member integrally with said closure member.

3. The method claimed in claim 1 wherein said step (a) is practiced by forming said retaining member as an insert for said closure member.

4. The method claimed in claim 1 wherein said step (b) is practiced by forming said indicating element onto said retaining member such that said retaining member protrudes through and has extent beyond such retained indicating element.

5. The method claimed in claim 4 including the further step, practiced after said step (b) and prior to said step (c), of staking such retaining member extent onto said retained indicating element.

6. The method claimed in claim 4 wherein said step (c) is practiced by securing said closure element to margins of said indicating element.

* * * * *